US006277158B1

(12) United States Patent
McLean

(10) Patent No.: US 6,277,158 B1
(45) Date of Patent: Aug. 21, 2001

(54) ADDITIVE CONCENTRATE FOR FUEL COMPOSITIONS

(75) Inventor: Gail McLean, Ampfield (GB)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/254,537

(22) PCT Filed: Sep. 11, 1997

(86) PCT No.: PCT/EP97/05015

§ 371 Date: Jul. 18, 2000

§ 102(e) Date: Jul. 18, 2000

(87) PCT Pub. No.: WO98/11175

PCT Pub. Date: Mar. 19, 1998

(30) Foreign Application Priority Data

Sep. 12, 1996 (EP) ..... 96202549

(51) Int. Cl.[7] ..... C10L 1/18; C10L 1/22
(52) U.S. Cl. ..... 44/399; 44/408
(58) Field of Search ..... 44/385, 408, 399

(56) References Cited

U.S. PATENT DOCUMENTS

| | | | |
|---|---|---|---|
| 2,433,716 | 12/1947 | Smith et al. | 44/68 |
| 2,686,713 | 8/1954 | White et la. | 44/62 |
| 2,736,658 | 2/1956 | Pfohl et al. | 106/14 |
| 2,862,800 | 12/1958 | Cantrell et al. | 44/66 |
| 2,902,353 | 9/1959 | Becker et al. | 44/71 |
| 2,996,366 | 8/1961 | Churchill et al. | 44/66 |
| 3,055,746 | 9/1962 | Eckert | 44/66 |
| 3,279,901 | 10/1966 | Robbins et al. | 44/66 |
| 3,442,630 | 5/1969 | Annable et al. | 44/66 |
| 3,454,381 | 7/1969 | Eckert | 44/66 |
| 3,658,494 | 4/1972 | Dorer, Jr. | 44/63 |
| 3,873,278 | 3/1975 | Poiss | 44/66 |
| 3,920,568 * | 11/1975 | Shaub | 508/498 |
| 3,955,940 | 5/1976 | Hollyday, Jr. | 44/62 |
| 3,996,024 | 12/1976 | Coon et al. | 44/71 |
| 4,130,494 * | 12/1978 | Shaub | 508/408 |
| 4,365,973 | 12/1982 | Irish | 44/56 |
| 4,537,694 | 8/1985 | Horodysky | 252/51.5 A |
| 4,780,111 | 10/1988 | Dorer et al. | 44/71 |
| 4,804,389 | 2/1989 | Johnston et al. | 44/70 |
| 5,006,130 | 4/1991 | Aiello et al. | 44/432 |
| 5,194,068 | 3/1993 | Mohr et al. | 44/391 |
| 5,197,997 | 3/1993 | Mozdzen et al. | 44/386 |
| 5,360,460 | 11/1994 | Mozdzen et al. | 44/386 |
| 5,968,211 | 10/1999 | Schilowitz | 44/402 |

FOREIGN PATENT DOCUMENTS

| | | | |
|---|---|---|---|
| 1021525 | 12/1957 | (DE) . | |
| 1905960 | 9/1969 | (DE) . | |
| 2022585 | 11/1970 | (DE) | C10L/1/18 |
| 0303862 | 2/1989 | (EP) | C10L/1/14 |
| 0476196 | 3/1992 | (EP) | C10L/1/14 |
| 0482253 | 4/1992 | (EP) | C10L/1/22 |
| 1193030 | 5/1970 | (GB) | C10L/1/22 |
| 1264058 | 2/1972 | (GB) | C10L/1/18 |
| 1338618 | 11/1973 | (GB) | C10L/1/22 |
| 2261441 | 5/1993 | (GB) | C10L/1/14 |
| WO98/05926 | 10/1987 | (WO) | C10M/159/12 |
| WO93/20170 | 10/1993 | (WO) | C10L/1/14 |
| WO96/23855 | 8/1996 | (WO) | C10L/1/14 |

* cited by examiner

*Primary Examiner*—Margaret Medley
*Assistant Examiner*—Cephia DiToomer
(74) *Attorney, Agent, or Firm*—Joseph J. Allocca

(57) ABSTRACT

An additive concentrate for use in fuels, especially in gasoline for internal combustion engines, comprising (a) 0.2 to 10 wt. % ashless friction modifier which is liquid at room temperature and pressure selected from (i) n-butylamine oleate or derivatives thereof, (ii) a substance comprising tall oil fatty acid or derivatives thereof, and (iii) mixtures of (i) and (ii); (b) 10 to 80 wt. % deposit inhibitor, and (c) carrier fluid. The particular selection of friction modifier (a) enables a stable additive concentrate to be formulated without the need for additional solubilising agent for the friction modifier, while containing sufficient friction modifier to achieve a significant benefit in fri loss, when incorporated in gasoline used to fuel an internal combustion engine, and hence an improvement in fuel economy.

7 Claims, No Drawings

ADDITIVE CONCENTRATE FOR FUEL COMPOSITIONS

This application is a 371 of PCT/EP/05015, filed Sep. 11, 1997.

This invention relates to an additive concentrate for use in fuels, especially in gasolines for internal combustion engines.

It is well-known that the performance of gasolines and other fuels can be improved through the use of additive technology. For example, detergents can be added to inhibit the formation of intake system deposits, thereby improving engine cleanliness. More recently it has been suggested that friction modifiers may be added to gasolines to increase fuel economy by reducing engine friction. In selecting suitable components for a detergent/friction modifier additive package it is important to ensure a balance of properties. The friction modifier should not adversely affect the deposit control of the detergent. In addition the package should not exhibit any harmful effects on the performance of the engine, such as valve sticking.

Current practice in the supply of gasoline is generally to pre-mix the fuel additives into a concentrate in a hydrocarbon solvent base, and then to inject the concentrate into gasoline pipelines used to fill tankers prior to delivery to the customer. Under present operating conditions, the maximum amount of concentrate that can be incorporated into a tanker of gasoline is typically about 2000 ppm based on the weight of the gasoline, of which about 700–1500 ppm is taken up by a conventional detergent-containing gasoline additive package. To facilitate injection of the concentrate into the gasoline, it is important that the concentrate is in the form of a low viscosity, homogeneous liquid. Problems have been encountered in achieving a stable concentrate due to the poor solubility of conventional friction modifiers, especially at low temperatures. The solubility of the friction modifier may be assisted by employing solubilising agents. However, the amount of solubilising agent required to solubilise the desired level of friction modifier in the concentrate often exceeds the maximum amount possible given the constraints on the amount of concentrate that can be injected into the gasoline, and the amount of solubilising agent that can be contained in the concentrate. In addition, some solubilising agents tend to react adversely with the friction modifier, or other additives contained in the concentrate, causing chemical degradation and/or a reduction in performance in the resulting gasoline composition.

Accordingly, there is a need for a detergent/friction modifier additive concentrate for gasoline that provides both deposit control and friction reduction, which is stable over the temperature range at which the concentrate may feasibly be stored, and which does not adversely affect the performance and properties of the finished gasoline or engine in which the gasoline is used.

The present invention provides an additive concentrate comprising by weight based on the total weight of the concentrate:

(a) 0.2 to 10% ashless friction modifier which is a liquid at room temperature and pressure selected from (i) n-butylamine oleate or derivatives thereof, (ii) a substance comprising tall oil fatty acid or derivatives thereof, and (iii) a mixture of (i) and (ii), (b) 10 to 80% deposit inhibitor, and (c) 10 to 80% carrier fluid.

The particular selection of friction modifier (a) enables a stable additive concentrate to be formulated within the current constraints of a maximum of approximately 2000 ppm by weight concentrate in the finished gasoline, of which up to about 1500 ppm is deposit inhibitor, whilst containing sufficient friction modifier to achieve a significant benefit in friction loss and hence an improvement in fuel economy, and without the need for additional solubilising agent for the friction modifier.

Solubilising agents, for example hydrocarbon solvents such as alcohols, may be included if desired, and therefore are not excluded from the scope of the present invention, but they are not an essential requirement.

The friction modifier is preferably a liquid over the temperature range at which the additive concentrate is likely to be stored. Typically this temperature range is from −20 to +35° C.

The friction modifier may be n-butylamine oleate or a derivative thereof, a substance comprising tall oil fatty acids or derivatives thereof or a mixture of these. Despite substantial research investigating a wide range of available friction modifier compounds, it has been found that only these two compound types provide the benefits explained above.

n-Butylamine oleate has the formula:

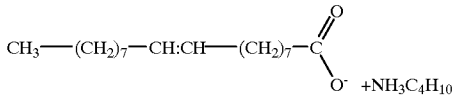

An example of a suitable commercially available n-butylamine oleate friction modifier is RS 124 supplied by Bitrez Ltd.

The substance comprising tall oil fatty acids may either be 100% tall oil fatty acids, or substantially 100% tall oil fatty acids, or may be a mixture of tall oil fatty acids and other fatty acids or derivatives thereof Preferably such a mixture contains at least 50 wt %, more preferably at least 70 wt %, tall oil fatty acids. An example of a suitable commercially available substance containing tall oil fatty acids is Tolad 9103 supplied by Petrolite Ltd.

The amount of friction modifier contained in the additive concentrate is from 0.2 to 10 wt %, preferably from 0.5 to 5 wt %, and more preferably from 1 to 4 wt %. On the basis of a total concentrate treat level in the finished gasoline of 2000 ppm by weight, this corresponds to a treat level of friction modifier in the finished gasoline of from 4 to 200 ppm, preferably 10 to 100 ppm, more preferably 20 to 60 ppm.

The deposit inhibitor (b) may be any suitable commercially available additive. Deposit inhibitors for gasoline, usually referred to as detergents or dispersants, are well known and a variety of compounds can be used. Examples include polyalkylene amines, and polyalkylene succinimides where the polyalkylene group typically has a number average molecular weight of from 600 to 2000, preferably from 800 to 1400, and polyether amines. A preferred detergent for the additive concentrate of the present invention is a polyalkylene amine, for example polyisobutylene amine. Examples of suitable PIB-amines are given in U.S. Pat. No. 4,832,702, the disclosure of which is incorporated herein by reference. Also, PIB-amine detergents can be obtained from, for example from Exxon Chemical Company, Oronite and BASF.

The amount of deposit inhibitor contained in the additive concentrate is from 10 to 80 wt %, preferably from 20 to 75 wt %, and more preferably from 30 to 60 wt %. Based on a total treat level of the additive concentrate of 2000 ppm by weight, this corresponds to a treat level of deposit inhibitor in the finished gasoline of from 50 to 1500 ppm, preferably 100 to 1000 ppm, more preferably 200 to 800 ppm.

The carrier fluid may be any suitable carrier fluid that is compatible with the gasoline and is capable of dissolving or dispersing the components of the additive package. Typically it is a hydrocarbon fluid, for example a petroleum or synthetic lubricating oil basestock including mineral oil, synthetic oils such as polyesters or polyethers or other polyols, or hydrocracked or hydroisomerised basestock. Alternatively the carrier fluid may be a distillate boiling in the gasoline range. The amount of carrier fluid contained in the additive concentrate of the invention is from 10 to 80 wt %, preferably from 20 to 75 wt %,and more preferably from 30 to 60 wt %.

The additive concentrate according to the invention may also contain a demulsifier to inhibit the formation of emulsion in the gasoline which can form if the gasoline becomes contaminated with water. A demulsifier is particularly advantageous if the friction modifier is the substance comprising tall oil fatty acids as the acids tend to promote any emulsification. Demulsifiers for gasoline are well known and examples of suitable compounds are alkoxylated phenol formaldehyde resins. If a demulsifier is employed in the additive concentrate it is preferably in an amount from 1 to 4 ppm by weight based on the weight of the gasoline.

The additive concentrate is preferably incorporated into the gasoline or other fuel by injection, although other suitable methods of incorporation may be used. To facilitate injection the kinematic viscosity of the additive concentrate is preferably less than 300 mm/s at −10° C., more preferably from 5 to 250 mm/s at −10° C., and most preferably from 10 to 200 mm/s at −10° C. To achieve this viscosity a solvent is usually added to the concentrate such as an aromatic hydrocarbon solvent or an alcohol. Examples include toluene, xylene, tetrohydrofuran, isopropanol isobutylcarbinol, n-butanol, and petroleum hydrocarbon solvents such as solvent naphtha heavy, and Solvesso 150 available from Exxon Chemical Company, and the like. Generally the amount of solvent employed is up to about 50 wt % based on the total weight of the additive concentrate, for example from 10 to 20 wt %.

The additive concentrate may also contain one or more other components typically contained in a fuel additive concentrate. These include, for example, antioxidants, corrosion inhibitors, conductivity enhancers, and the like. Generally each of these additional components is included in the concentrate in an amount which corresponds to a treat level of between 1 and 20 ppm by weight in the finished fuel composition.

In another aspect the present invention provides a fuel composition comprising combustible fuel and from 500 to 2500 ppm by weight of an additive combination comprising components (a), (b) and (c) as defined in any of the preceding claims.

The fuel used in the fuel composition of this invention is generally a petroleum hydrocarbon useful as a fuel e.g. gasoline, for internal combustion engines. Such fuels typically comprise mixtures of hydrocarbons of various types, including straight and branched chain paraffins, olefins, aromatics and naphthenic hydrocarbons. These compositions are provided in a number of grades, such as unleaded and leaded gasoline, and are typically derived from petroleum crude oil by conventional refining and blending processes such as straight run distillation, thermal cracking, hydrocracling, catalytic cracking and various reforming processes. Gasoline may be defined as a mixture of liquid hydrocarbons or hydrocarbon-oxygenates having an initial boiling point in the range of about 20 to 60° C. and a final boiling point in the range of about 150 to 230° C., as determined by the ASTM D86 distillation method. The gasoline may contain small amounts, eg up to 20 wt % and typically about 10 wt %, other combustibles such as alcohol, for example methanol or ethanol.

Other fuels which may be used include combustible fuels such as kerosene, diesel fuels, home heating fuels, jet fuels etc.

The invention shall now be illustrated with reference to the following Examples:

EXAMPLE 1

A number of different additive concentrates were prepared by blending (a) a friction modifier, (b) a detergent, and (c) a carrier fluid. The friction modifier was selected from one of a number of commercially available products. The detergent was either a polyisobutylene-amine, a polyisobutylene succinimide or a polyether amine. These detergents are well known and commercially available. For each detergent type, the same product was used throughout the Examples to ensure direct comparability of the results. The carrier fluid, a polyether, was the same throughout the Examples.

The stability of each of the resulting additive concentrates was determined by exposing samples of the concentrate to temperatures of −20° C., −10° C., 0° C., ambient and +35° C. and periodically inspecting the samples for sediment formation, water content, haze, and emulsion formation. A concentrate which remained stable for at least 3 months over the entire temperature range is considered to meet the stability requirements.

TABLE 1

| Example | Friction | Treat Level | | Stability | | | | |
|---|---|---|---|---|---|---|---|---|
| No. | Modifier | (ppm) | Detergent | −20° C. | −10° C. | 0° C. | Ambient | +35° C. |
| 1.01 | Atsurf 594 | 100 | PIBA | <1 day | <1 day | <1 day | <1 day | <1 day |
| 1.02 | Tolad 9103 | 25 | PIBA | >4 mths | >4 mths | >4 mths | >4 mths | >4 mths |
| 1.03 | Tolad 9103 | 50 | PIBA | >4 mths | >4 mths | >4 mths | >4 mths | >4 mths |
| 1.04 | Tolad 9103 | 100 | PIBA | >4 mths | >4 mths | >4 mths | >4 mths | >4 mths |
| 1.05 | Tolad 9103 | 25 | PEA | >8 mths | >8 mths | >8 mths | >8 mths | — |
| 1.06 | Tolad 9103 | 50 | PEA | >8 mths | >8 mths | >8 mths | >8 mths | — |
| 1.07 | Tolad 9103 | 100 | PEA | >8 mths | >8 mths | >8 mths | >8 mths | — |
| 1.08 | Tolad 9103 | 25 | PIBS (1240 ppm) | >1 mth | >1 mth | >1 mth | >1 mth | >1 mth |
| 1.09 | ECA 5778/116 | 50 | PIBA | <1 week | — | — | — | — |
| 1.10 | ECA 5778/116 | 50 | PEA | <1 week | — | — | — | — |
| 1.11 | EX69-169 | 50 | PIBA | >3 mths | >3 mths | >3 mths | >3 mths | — |

TABLE 1-continued

| Example No. | Friction Modifier | Treat Level (ppm) | Detergent | Stability −20° C. | −10° C. | 0° C. | Ambient | +35° C. |
|---|---|---|---|---|---|---|---|---|
| 1.12 | EX69-169 | 100 | PIBA | >3 mths | >3 mths | >3 mths | >3 mths | — |
| 1.13 | EX69-169 | 50 | PEA | >4 mths | >4 mths | >4 mths | >4 mths | — |
| 1.14 | EX69-169 | 100 | PEA | >4 mths | >4 mths | >4 mths | >4 mths | — |
| 1.15 | M10229 | 50 | PIBA | <1 day | — | — | — | — |
| 1.16 | M10229 | 50 | PEA | <1 day | — | — | — | — |
| 1.17 | SMO | 50 | PIBA | <1 day | >7 mths | >7 mths | >7 mths | — |
| 1.18 | SMO | 100 | PEA | <2 days | >3 mths | >3 mths | >3 mths | — |
| 1.19 | n-BAO | 25 | PIBA | >4 mths | >4 mths | >4 mths | >4 mths | >4 mths |
| 1.20 | n-BAO | 50 | PIBA | >4 mths | >4 mths | >4 mths | >4 mths | >4 mths |
| 1.21 | n-BAO | 100 | PIBA | >4 mths | >4 mths | >4 mths | >4 mths | >4 mths |
| 1.22 | n-BAO | 25 | PEA | — | — | — | — | — |
| 1.23 | n-BAO | 50 | PEA | >6 mths | >6 mths | >3 mths | >3 mths | — |
| 1.24 | n-BAO | 100 | PEA | >6 mths | >6 mths | >3 mths | >3 mths | — |
| 1.25 | 10G40 | 50 | PIBA | >3 mths | <60 days | — | >3 mths | — |
| 1.26 | PMO | 50 | PIBA | >5 mths | — | — | — | — |
| 1.27 | PMO | 100 | PIBA | >5 mths | — | — | — | — |
| 1.28 | PMO | 50 | PEA | >5 mths | — | — | — | — |
| 1.29 | PMO | 100 | PEA | >5 mths | — | — | — | — |
| 1.30 | Edenor PDO | 50 | PIBA | >5 mths | — | — | — | — |
| 1.31 | Edenor PDO | 100 | PIBA | >5 mths | — | — | — | — |
| 1.32 | Edenor PDO | 50 | PEA | >5 mths | — | — | — | — |
| 1.33 | Edenor PDO | 100 | PEA | >5 mths | — | — | — | — |

Notes to TABLE 1
Atsurf 594 is a glycerol mono oleate friction modifier available from ICI.
Tolad 9103 is a tall oil fatty acid mixture friction modifier containing about 75 wt. % active ingredient (remainder diluent) available from Petrolite.
ECA 5778/116 is an oleic acid polyol ester friction modifier available from Exxon Chemical Company.
EX69-169 is Mayco EX69-169, a sulphurised fatty acid amide friction modifier available from Mayco.
M10229 is Addition M10229, a fatty amide friction modifier available from Rhein Chemie.
SMO is Sorbitan mono oleate friction modifier available from Henkel.
n-BAO is n-butylamine oleate friction modifier available from Bitrez.
10G40 is a polyglycerol ester friction modifier available from Caprol.
PMO is pentaerithrytol mono oleate friction modifier available from Henkel.
Edenor PDO is pentaerithrytol di oleate friction modifier available from Henkel.
PIBA is a polyisobutylene-amine detergent.
PEA is a polyetheramine detergent.
PIBS is a polyisobutylene succinimide detergent.

Notes to TABLE 1

Atsurf 594 is a glycerol mono oleate friction modifier available from ICI.

Tolad 9103 is a tall oil fatty acid mixture friction modifier containing about 75 wt. % active ingredient (remainder diluent) available from Petrolite.

ECA 5778/116 is an oleic acid polyol ester friction modifier available from Exxon Chemical Company.

EX69-169 is Mayco EX69-169, a sulphurised fatty acid amide friction modifier available from Mayco.

M10229 is Additin M10229, a fatty amide friction modifier available from Rhein Chemie.

SMO is Sorbitan mono oleate friction modifier available from Henkel.

n-BAO is n-butylamine oleate friction modifier available from Bitrez.

10G40 is a polyglycerol ester friction modifier available from Caprol.

PMO is pentaerithrytol mono oleate friction modifier available from Henkel.

Edenor PDO is pentaeritbrytol di oleate friction modifier available from Henkel.

PIBA is a polyisobutylene-amine detergent.

PEA is a polyetheramine detergent

PIBS is a polyisobutylene succinimide detergent

The results show that only additive concentrates containing certain friction modifiers are stable with each type of detergent over the full temperature range and treat levels. These are: Tolad 9103, Mayco EX69-169, n-BAO, Henkel PMO, and Edenor PDO.

Example 2

The additive concentrates of Example 1 which passed the stability test were then tested to ensure that the friction modifier contained in the concentrate did not have a detrimental affect on deposit control, inlet valve sticking, and friction and wear.

Deposit control was measured according to standard engine test M102E (CEC F-05-A-93). The lower the amount of deposits on the valve (measured in mg/valve) at the end of the test, the better the deposit control of the additive package. A target level is no more than 25 mg/valve.

Valve sticking was determined by operating an Opel Ascona 1.61 4-cylinder engine with automatic choke for 100 hours under cyclic conditions. The cycle is intended to simulate urban driving with repeated cold starting of the engine. At the end of the test period the cylinder head is turned to allow the valves to fall freely out of the valve guides under their own weight. A clear pass is awarded when all of the valves move freely.

Friction and wear were determined by a standard high frequency reciprocating rig (HFRR) test. The test measures friction coefficient and wear scar diameter (WSD). The lower the values the better the performance of the additive package, the targets being a friction coefficient of no more than 0.25 and a WSD of less than 500$\mu$ The results are given in Table 2.

TABLE 2

| Example No. | Deposit control (mg/valve) | Valve stick | Friction coefficient | WSD ($\mu$) |
|---|---|---|---|---|
| 1.02 | 9.61 | — | — | — |
| 1.03 | — | Pass | 0.25 | 430 |
| 1.04 | — | — | 0.178 | 378 |
| 1.05 | 16 | — | — | — |
| 1.06 | 38 | — | 0.19 | 470 |
| 1.07 | — | — | 0.17 | 425 |
| 1.08 | 12.75 | Pass | — | — |
| 1.11 | — | — | 0.228 | 550 |
| 1.12 | — | — | 0.206 | 540 |
| 1.13 | — | — | 0.277 | 675 |
| 1.14 | — | — | 0.228 | 555 |
| 1.22 | 4.75 | Pass | 0.168 | 425 |
| 1.23 | — | — | 0.151 | 470 |
| 1.24 | 11.5 | — | — | — |
| 1.25 | 5.5 | Pass | 0.179 | 450 |
| 1.26 | — | — | 0.169 | 450 |
| 1.28 | — | — | 0.269 | 640 |
| 1.29 | — | — | 0.239 | 565 |
| 1.30 | — | — | 0.262 | 660 |
| 1.31 | — | — | 0.195 | 515 |
| 1.32 | — | — | 0.269 | 660 |
| 1.33 | — | — | 0.252 | 610 |
| 1.34 | — | — | 0.27 | 660 |
| 1.35 | — | — | 0.22 | 560 |

The results show that the best performance and least harm is achieved using either the Tolad 9103 or n-BAO friction modifiers. All the other friction modifiers either did not have a sufficiently low friction coefficient (target no higher than 0.25), and/or resulted in excessive wear (target WSD less than 500$\mu$).

Regarding preferred treat levels for the friction modifiers, the n-BAO friction modifier did not show a substantial difference in performance over the 25–100 ppm treat levels used. However for the Tolad 9103 friction modifier the treat level is preferably below 50 ppm, for example about 25 ppm, in order to maintain inlet valve deposits below a target maximum of 25 mg/valve.

EXAMPLE 3

The additive concentrate examples according to the invention were tested for fuel economy benefit. These concentrates were Example 1.02 (25 ppm Tolad 9103+ PIBA detergent) and Example 1.19 (50 ppm n-BAO + PIBA detergent). The results were compared with those of a fuel containing the same PIBA detergent but no friction modifier.

Two tests were used: (1) A bench engine test method employing standard ECE/EUDC driving cycles according to standard test PL-054, and (2) a fleet test method employing standard ECE/EUDC driving cycles according to standard test EG-RL 80/1268/EWG (including amendment EG-RL 93/116/EWG.

The results are given in Table 3 below.

TABLE 3

| | | Fuel Economy Benefit (%) | |
|---|---|---|---|
| Test Procedure | Vehicles | 25 ppm Tolad 9103 | 50 ppm n-BAO |
| Bench Engine | Ford Sigma (3000 miles) | 1.1 | 0.53 |
| | Mercedes M111E | 0.49 | 0.33 |
| Mean | | 0.80 | 0.43 |
| 8 Car Fleet | Ford Escort | 1.15 | 0.72 |
| | Mercedes 200E | 0.28 | 1.02 |
| | Peugeot 405 | 1.44 | 2.28 |
| | Rover 216 | −0.22 | 1.30 |
| Mean | | 0.66 | 1.32 |

The results show that a gasoline containing one of the above friction modifiers give an overall mean benefit in fuel economy relative to the same gasoline without the friction modifier of between 0.6 and 1%, with a maximum benefit of 1.44% for the Tolad 9103 and 2.28% for the n-Bao.

What is claimed is:

1. A fuel composition comprising:

a combustible fuel; and from 500 to 2500 ppm by weight based on the weight of fuel of an additive combination comprising:

(a) 0.2 to 10 wt % ashless friction modifier which is a liquid at room temperature and pressure selected from the group consisting of (i) n-butyl amine oleate or derivatives thereof and (ii) a mixture of (i) with a substance comprising tall oil fatty acids or derivatives thereof;

(b) 10 to 80 wt % deposit inhibitor; and (c) 10 to 80 wt % carrier fluid.

2. The composition of claim 1 wherein the fuel is selected from the group consisting of gasoline, diesel fuel and jet fuel.

3. The composition of claim 2 wherein the fuel is gasoline.

4. The fuel composition of claim 2 or 3 wherein the ashless friction modifier is n-butyl amine oleate.

5. The composition of claim 4 wherein the amount of friction modifier (a) is from 0.5 to 10 wt %.

6. The composition of claim 5 wherein the deposit inhibitor (b) is selected from the group consisting of polyalkylene amines, polyalkylene succinimides and mixtures thereof.

7. The composition of claim 6 wherein the amount of deposit inhibitor (b) is from 20 to 75 wt %.

* * * * *